United States Patent [19]

Hartman et al.

[11] 3,964,215

[45] June 22, 1976

[54] FOLDING HANDRAILS FOR TELESCOPING SEATING SECTIONS

[75] Inventors: Arlin P. Hartman; Richard A. Vance, both of Champaign, Ill.

[73] Assignee: Universal Bleacher Company, Champaign, Ill.

[22] Filed: Feb. 18, 1975

[21] Appl. No.: 550,478

[52] U.S. Cl. ..... 52/9; 256/65; 256/67

[51] Int. Cl.[2] ..... F04H 3/12

[58] Field of Search ..... 52/183, 184, 9, 10; 256/59, 65–70, 21, 24; 182/78, 106

[56] References Cited

UNITED STATES PATENTS 3,401,918 9/1968 Wiese ..... 256/59

FOREIGN PATENTS OR APPLICATIONS 1,064,407 12/1953 France ..... 52/183

*Primary Examiner*—John E. Murtagh

*Attorney, Agent, or Firm*—Dawson, Tilton, Fallon & Lungmus

[57] ABSTRACT

In a telescoping seating system with folding handrails, the posts for the handrails are mounted to the side of the seating row sections; and the posts are inclined at an acute angle relative to the vertical. Upper and lower telescoping rail assemblies are both pivotally mounted by means of a vandalproof lock at the inner side of the posts so that the upper rail assembly is located directly above the lower one. Architectural end rails may be mounted to the top and bottom posts, if desired, using the same locking hardware.

6 Claims, 5 Drawing Figures

FOLDING HANDRAILS FOR TELESCOPING SEATING SECTIONS

BACKGROUND AND SUMMARY

The present invention relates to folding handrails which are particularly adapted for use with telescoping seating systems; and more particularly, it relates to improvements in folding handrails of the type disclosed in the U.S. patent of Harold Wiese, U.S. Pat. No. 3,401,918 entitled "Foldable Handrail", issued Dec. 17, 1968.

In seating systems of this type, individual row sections are adapted to fold or telescope beneath an upper row section when the system is retracted to assume a minimum space for storage. During use, the row sections are extended outwardly in stepped relation.

Prior to the system disclosed in the above-referenced patent most handrails for telescoping seating systems had to be removed prior to retraction for storage of the row sections. Typically, these handrails were stored in the space between adjacent row sections. These early systems therefore required the use of maintenance personnel to install the handrails prior to use and to remove them prior to retraction of the seating system. Because it was necessary to mount the rails in such a way that they could not easily be tampered with or removed by an occupant, such as a student, the amount of time required to mount and remove the rail sections led to their general non-use. That is, the handrails would be stored in a location apart from the seating systems in some cases, and they were not always installed for use.

With the system indicated above, the rail assemblies are secured to the row sections and need not be removed when the seating system is retracted.

The present invention, briefly, is directed toward certain improvements of the system just referred to. These improvements include apparatus for mounting the individual posts of a handrail assembly to the side, rather than in front, of the seating rows. At the same time, the posts are inclined at an acute angle relative to the vertical. That is, the upper ends of the posts are extended outwardly from the back of the seating system.

Thus, with the present invention, upper and lower handrail assemblies can be used, and they can be mounted on the same side (preferably the inner side) of the post without interference. Further, in the retracted position, the posts do not extend outwardly in front of the seating system, and this provides an aesthetic as well as a safety feature. Still further, the present invention employs novel apparatus for securing the rail assemblies to the posts in a vandalproof manner, although nothing more than ordinary hand tools such as are normally available during installation are required for assembling the vandalproof lock.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
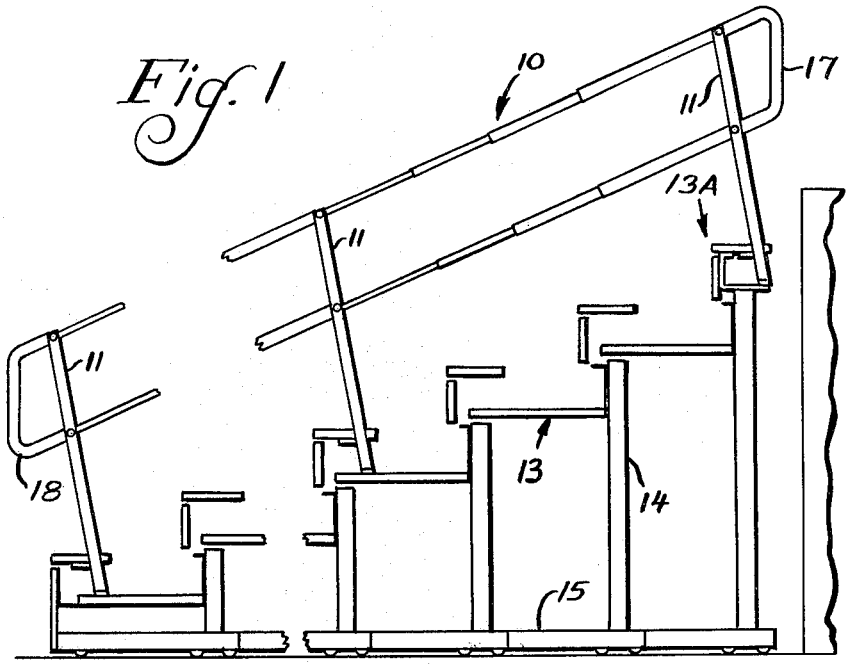
FIG. 1 is a diagrammatic side view of a telescoping seating system incorporating the present invention and shown in an extended or use position.

Referring first to FIG. 1, reference numeral 10 generally designates a telescoping rail supported by three posts 11. The posts are carried by a telescoping seating system of the type described in U.S. Pat. No. 3,667,171, of McClelland and Raymond, issued June 6, 1972.

Figure 2:
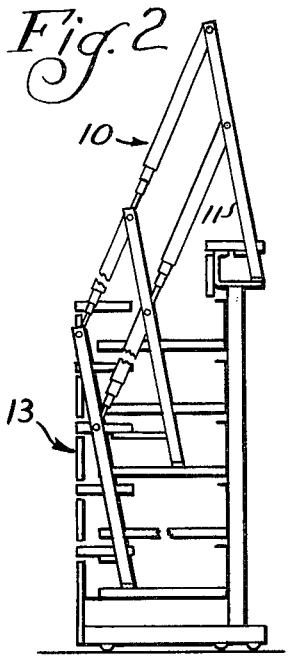
FIG. 2 is a view similar to FIG. 1 with the seating system in a closed or storage position.

Briefly, the telescopic seating system includes a plurality of row sections, each designated 13 which are supported by understructures generally designated 14 which, in turn, are movably carried by carriages 15. The seating sections 13 are shown in FIG. 1 in the expanded or use position, and they are shown in FIG. 2 in the closed or storage position. The uppermost seat, designated 13A, in the illustration is fixed. It will be observed in FIG. 2 that the telescoping rails assume a generally upright position when the system is retracted; i.e., as the seating sections are telescoped to the storage position.

Figure 3:
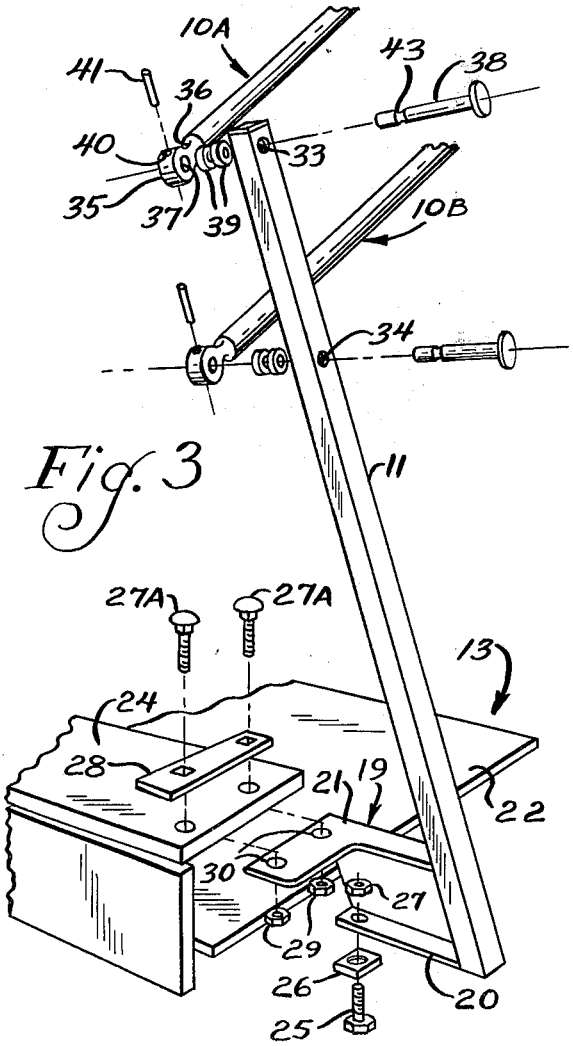
FIG. 3 is a perspective view, partially broken away, of a post assembly for the lowermost rail, with the parts in exploded relation.
Figure 4:
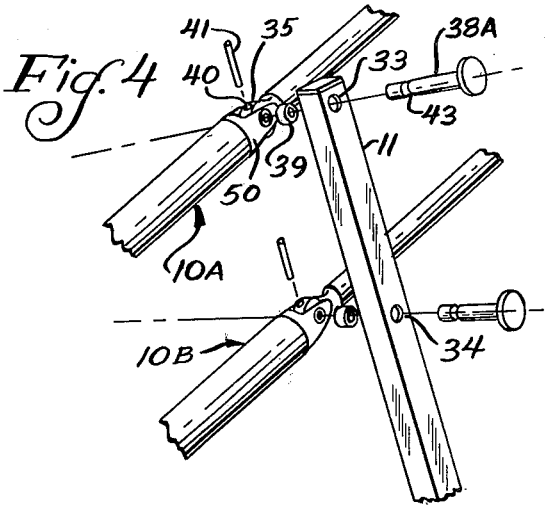
FIG. 4 is a perspective view showing the interconnection of the post and rail at an intermediate position, again with the interconnecting parts shown in exploded relation.

From FIG. 1 and FIG. 3 it can be seen that the posts 11 are mounted at an angle relative to the vertical — that is, the upper portion of each post extends forwardly and outwardly of its associated connection to the seating system. This is considered to be an important advantage of the present invention because it accommodates the mounting of both rails on the same side of the post, as best seen in FIGS. 3 and 4, and as distinguished from the prior art. It also permits the generally vertical orientation of the rails in the folded position, as seen in FIG. 2.

Upper and lower formed rail sections 17, 18 (seen in FIG. 1 but omitted in FIG. 2) are mounted respectively to the uppermost and lowest of the posts 11.

Referring now to FIG. 3, the post 11 shown there is the lowermost post, although, as will be discussed later, it is not designed to accommodate the lower architectural rail 18. The manner for doing this, if it is desired, will be explained subsequently.

At the lower end of the post 11 there is a channel-shaped member generally designated 19 including a lower horizontal strip 20 and an upper L-shaped mounting member 21.

The strip 20 is used to mount the post 11 to a footboard 22 of a seating section 13; and the L-shaped member 20 is used to mount the post to a seatboard 24 of the same seating section 13. It will be observed that once it is mounted to a seating section, the post assembly cannot be rotated or moved.

The strip 20 is mounted by means of a threaded bolt 25, a backing plate 26, and a nut 27. The L-shaped member 21 is similarly mounted by means of carriage bolts 27A, an elongated mounting plate 28, and nuts 29. The bolts 27 extend through apertures 30 in the foot of the L-shaped member 21.

At the top of the post 11 there are provided first and second spaced apertures 33, 34 for mounting an associated rail assembly. The upper rail assembly is designated 10A, and the lower rail assembly is designated 10B. Each of the rail assemblies 10A, 10B is mounted to the rail 11 in a similar manner, so that only one need be discussed for an understanding of the invention. However, it will be appreciated that the axes of each of the telescoping sections 10A, 10B are parallel and extend in the same vertical plane for all positions between the extended and retracted positions shown in FIGS. 1 and 2 respectively.

Turning then to the upper rail section 10A, a vandal proof lock joint includes a knuckle 35 having a neck 36 which is received in the lowermost tube forming the assembly 10A. The knuckle 35 includes a transverse aperture 37 for receiving a locking pivot pin 38 which fits through the aperture 33. A pair of nylon spacers 39 are located between the post 11 and the knuckle 35 to achieve the proper spacing in aligning the axes of the tubes, as will be clear from subsequent discussion.

A second aperture 40 is formed in the knuckle 35, and the aperture 40 is formed in such a manner as to insure that a pin 41, passing through it, will be aligned with and pass through an associated annular recess 43 on the locking pin 38 when that locking pin is assembled to the knuckle 35. This mounting assembly has been found to provide a vandal-proof mechanism for attaching the rails to the posts, yet one which is simple and easy to install, requiring only the use of a hammer to drive the pin 41 into the aperture 40 when the locking pin 38 is properly assembled. Further, the structure just described permits rotation of the knuckle 35 relative to the post 11, as is required during involvement between the use and storage positions.

Turning now to FIG. 4, there is shown an intermediate row post mounting assembly, the post again being designated 11 and including aperatures 33, 34. Again, the upper post assembly 10A is mounted to the post 11 in a manner similar to the rail assembly 10B, so that only one need be disclosed further. This assembly includes a locking pin 38A which is slightly longer than that previously described but which includes an annular recess 43 at the same distance from the head of the pin.

The upper rail assembly 10A includes a knuckle 35 similar to that which has already been described. The lower rail section coupling to it includes a clevis member 50 which fits about the knuckle 35 and includes side apertures for aligning with the aperture in the knuckle 35 when assembled to it. Again, in assembly, the pin 38A is placed through the aperture 33 in the post 11, and through a single nylon spacer 39, through the apertures in the clevis 50 and the knuckle 35 in such a manner that the annular recess 43 of the pin 38A is in vertical alignment with the aperture 40 in the knuckle 35. Thus, when the pin 41 is force-fitted into the aperture 40, the lock pin 38A is secured in place, while permitting rotation; and the assembly is held together in a vandalproof manner.

Figure 5:
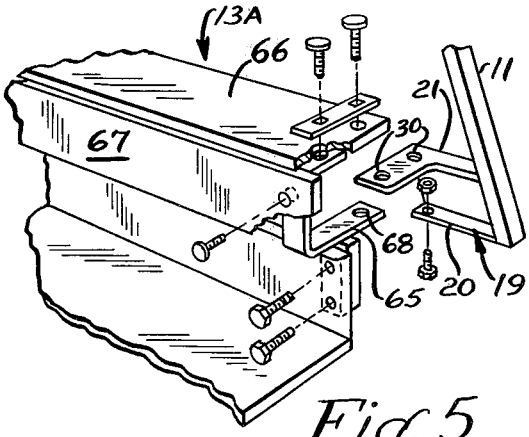
FIG. 5 is a close-up perspective view, again with the parts in exploded relation, showing the apparatus for mounting a post to the uppermost seat.

Turning now to FIG. 5, there is shown apparatus for mounting the uppermost row post to the highest seat 13A which, it will be understood, does not include a rear footboard. The post 11 and channel bracket 19 are similar to those which have already been described, as are the hardware assemblies for mounting the members 20, 21. However, there is included a separate C-shaped bracket 65 which is located beneath the uppermost seat board 66 and behind the uppermost riser 67, extending rearwardly thereof and including an aperture 68 for mounting the strip 20 of bracket 19. The upper horizontal portion of the bracket 65 extends to register with the forward one of the apertures 30 on the L-shaped member 21, for strengthening the mount.

The architectural end rails 17, 18 of FIG. 1, if used, may be attached to the handrails using the same hardware as is used for attaching the telescoping handrails—namely, a knuckle such as that shown at 35 in FIG. 3 for the upper end rail 17, and a clevis member 50 for each end of the lower rail 18.

Having thus described in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In a telescoping seating system having a plurality of row sections movable between a closed storage position in which said row sections are in superposed relation and an open use position in which said row sections are in stepped relation and including a folding handrail secured to said row sections and movable therewith between said closed and open positions, said handrail including a plurality of posts and upper and lower telescoping rail means pivotally connected between adjacent posts, the improvement comprising: bracket means secured to a row section for each of said posts and extending laterally thereof, each bracket means holding an associated post inclined at an acute angle relative to the vertical with the upper end of a post extending upwardly and outwardly of an associated bracket means; and pivot connection means for mounting said upper and lower rail means to the same side of said posts, whereby the axes of said upper and lower rail means lie in the same vertical plane and said rail means do not extend in front of said seating system when said system is in closed position.

2. The system of claim 1 wherein each of said upper and lower rail means includes a plurality of telescoping rail sections connected at their ends by said pivot connection means, said pivot connection means further securing the ends of said rail sections to an associated post.

3. The system of claim 2 wherein said pivot connection means includes a knuckle mounted to one of said rail sections, a clevis member mounted to the adjacent end of another rail section, each of said knuckle and clevis members being apertured, said apertures being aligned when said members are assembled; a lock pin extending through an associated post and pivotally received in the aligned apertures of said knuckle and clevis member; and pin means for locking said lock pin in said assembled position.

4. The apparatus of claim 3 wherein said knuckle defines a second hole extending transverse of said first aperture and communicating therewith, and wherein said lock pin includes an annular recess which aligns with said second aperture of said knuckle when said lock pin is in assembled relation therewith, said lock means comprising a pin force-fit through said second aperture of said knuckle and extending at least partially through said annular recess of said lock pin, whereby the ends of said rail sections may freely pivot on said lock pin and remain secured to said post in a vandal-proof manner.

5. The apparatus of claim 1 wherein said bracket means comprises a channel-shaped member including a vertical section secured to an associated post and upper and lower laterally extending section, the upper laterally extending sections being secured to a seatboard, and the lower laterally extending section being secured to a footboard of a row section.

6. The system of claim 1 further comprising upper and lower architectural rail means in the form of a C connected respectively to the highest and lowest post of a seating section, and each including an upper and a lower rail section acting to continue an associated one of said upper and lower telescoping rail means, and a vertical end piece.

* * * * *